US006070636A

United States Patent [19]

Zaher

[11] Patent Number: 6,070,636

[45] Date of Patent: Jun. 6, 2000

[54] APPARATUS FOR APPLYING A DECORATION TO AT LEAST ONE ARTICLE

[75] Inventor: Maximilian Zaher, Oldenberg, Germany

[73] Assignee: Bush Industries, Inc., Jamestown, N.Y.

[21] Appl. No.: 09/074,485

[22] Filed: May 6, 1998

[30] Foreign Application Priority Data

May 7, 1997 [EP] European Pat. Off. ..... 97 107 542

[51] Int. Cl.[7] ..... B44C 31/00; B05C 3/02; B05C 13/00; B41M 3/12; B05G 9/00

[52] U.S. Cl. ..... 156/540; 156/230; 156/236; 156/285; 118/402; 118/403; 118/416; 118/423; 118/428; 118/503; 427/147; 414/627

[58] Field of Search ..... 156/230, 236, 156/285, 384, 540, 547, 584; 118/402, 403, 416, 423, 428, 503; 427/149, 430.1; 414/627

[56] References Cited

U.S. PATENT DOCUMENTS

| | | | |
|---|---|---|---|
| 2,981,632 | 4/1961 | Bennett | 117/39 |
| 4,010,057 | 3/1977 | Nakanishi | 156/384 |
| 4,229,239 | 10/1980 | Arai et al. | 156/155 |
| 4,231,829 | 11/1980 | Marui et al. | 156/230 |
| 4,269,650 | 5/1981 | Arai et al. | 156/540 |
| 4,348,246 | 9/1982 | Nakanishi | 156/73.1 |
| 4,353,942 | 10/1982 | Carey | 427/434.3 |
| 4,388,866 | 6/1983 | Nakanishi | 101/426 |
| 4,407,881 | 10/1983 | Shima et al. | 428/156 |
| 4,436,571 | 3/1984 | Nakanishi | 156/384 |
| 5,174,712 | 12/1992 | Focke et al. | 414/796.5 |
| 5,260,098 | 11/1993 | Trentsaux et al. | 427/347 |
| 5,632,595 | 5/1997 | Mori et al. | 414/795.6 |
| 5,655,318 | 8/1997 | Daniels | 37/321 |

*Primary Examiner*—Richard Crispino
*Assistant Examiner*—J. A. Lorenzo
*Attorney, Agent, or Firm*—Webb Ziesenheim Lodsgon Orkin & Hanson, P.C.

[57] ABSTRACT

An apparatus for applying a decoration to at least one article provides that the article is immersed through a liquid which is contained in a tank and on which the decoration floats. The apparatus has a pallet whose inclination α with respect to the horizontal plane can be adjusted using at least two height adjustable arms.

10 Claims, 7 Drawing Sheets

APPARATUS FOR APPLYING A DECORATION TO AT LEAST ONE ARTICLE

BACKGROUND OF THE INVENTION

1. Field of the Invention

The invention relates to an apparatus for applying a decoration to at least one article using a tank which contains a liquid on which the decoration floats.

2. Description of Related Prior Art

U.S. Pat. No. 4,010,057, corresponding to German Patent No. DE-A-25 34 640, describes a method and apparatus for applying a decoration to an article using hydrostatic pressure. This patent is hereby incorporated by reference.

U.S. Pat. No. 4,348,246 and U.S. Pat. No. 4,388,866 describe transfer printing techniques in which the film with the decoration to be transferred is not placed upon a layer of water but instead is placed upon a layer of granules or a deformable layer of pins.

U.S. Pat. No. 4,436,571 describes a transfer printing technique in which the article to receive a decoration is immersed in a specific way into a flowing liquid with the decoration floating thereupon. The article is presented to the decoration in a continuous movement in the general direction of the liquid flow along a downward path oblique to the surface of the liquid and then along an upward path oblique to the surface of the liquid to provide contact between the decoration and the article. The article is immersed within a liquid in a zig-zag motion wherein the angle the article enters and exits the liquid is adjustable. With this known technique the decoration of an article having a relatively complex shape is very difficult and frequently entails trial and error tests which are costly.

U.S. Pat. No. 4,407,881, corresponding to German Patent DE-A-32 19 992, describes a transfer printing technique in which the decoration is supported on a layer of a special film made of a hydrophilic, deformable layer which can swell by absorption of water, and a further layer which is placed over the hydrophilic layer and is varyingly permeable to water so that the hydrophilic layer expands to a greater or lesser extent.

U.S. Pat. Nos. 4,229,239 and 4,269,650 describe another transfer printing technique in which the decoration is prepared before the transfer by a solvent in order that it detaches itself more easily from the supporting film when transferred onto the article. This activation of the decoration (printing pattern) takes place directly before transferring the film with the decoration to the surface of the water. The film supporting the decoration is water soluble so that, upon contact with the water, the film dissolves and the decoration is then floating on the surface of the water alone (without the film). The decoration is then transferred to the article to be decorated by subsequent immersion of the article. This technique utilizes a solvent in order to make the detachment of the decoration from the supporting film easier.

U.S. Pat. No. 4,231,829 describes a transfer printing technique in which boric acid or a salt thereof is added to the PVA film supporting the decoration on the liquid or to the water on which the decoration floats in order to promote the transfer process.

In prior art designs, the article to be decorated is moved along two dimensions in a main plane of movement. The main plane of movement is defined by two vectors; a vector corresponding to the direction of the flow of the liquid and a vector perpendicular (normal) to the surface of the liquid.

It is difficult to match the movement of the article during the immersion operation precisely to the flow speed of the liquid or to the movement of the decorative film floating on the liquid, and it is also difficult to adjust the expansion of the decoration on the liquid precisely in relation to the requirements of the article and its immersion movement. The prior art processes, in general, contain too many uncontrolled parameters which must be controlled to effectively transfer with precision a decoration onto an article.

U.S. patent application Ser. No. 08/966,811 filed Nov. 10, 1997 and titled "Method and Apparatus for Manipulating an Article for Applying a Decoration Thereon," discloses an apparatus which uses a robot to move and immerse an article to be decorated in such a way that its movement also has components transverse to a main plane of movement defined by a vector in the direction of flow of the water and a vector perpendicular to the surface of the water. The present invention also provides that the article to be decorated is moved during immersion in such a way that its movement has components transverse to its main plane of movement. In other words, the article is moved in three dimensions through the liquid rather than moved just in two dimensions.

One object of the present invention is to provide a decoration application apparatus capable of guiding a multiplicity of articles through the tank at a high throughput while maintaining high quality in the application of the decoration.

SUMMARY OF THE INVENTION

In order to solve this problem, the apparatus according to the subject invention has a pallet to which the article to be decorated may be fastened for immersion into flowing liquid in a tank. The inclination of the pallet with respect to the horizontal plane can be adjusted using at least two height adjustable arms supporting the pallet.

A preferred embodiment of the invention provides for each arm to be height adjustable vertically in the direction of its longitudinal axis.

The pallet can be removably fastened to the lower ends of the arms so that changing the pallet is a straightforward process.

In a further preferred embodiment of the invention, the pallet may be fastened in an articulated manner to the arms such that the angle between the plane of the pallet and the vertical longitudinal axis of the arms is adjustable.

A further preferred embodiment of the invention provides for the arms to be supported by a carriage which can be displaced on a rail along the longitudinal direction of the tank.

A particularly high throughput of articles to be decorated is achieved by providing a carriage on each side of the tank. Each carriage can be displaced in the longitudinal direction of the tank.

In another preferred embodiment of the invention the pallet is detachably fastened to the arms by means of a suction device.

Another embodiment of the invention provides for a device with which the angle between the plane of the pallet and the main plane of movement of the article can be adjusted. Using this device, which is preferably fixedly arranged as a motor on the carriage, it is possible for the pallet articles to be decorated fastened thereon to pivot about an axis of rotation which lies in the main plane of movement. This results in three-dimensional movement of the articles.

BRIEF DESCRIPTION OF THE DRAWINGS

Exemplary embodiments of the invention are described in more detail below using the drawings, in which.

DESCRIPTION OF THE PREFERRED EMBODIMENTS

In the figures, components which correspond to one another are provided with identical reference symbols, if necessary differentiated by a prime or a small letter.

Figure 1:
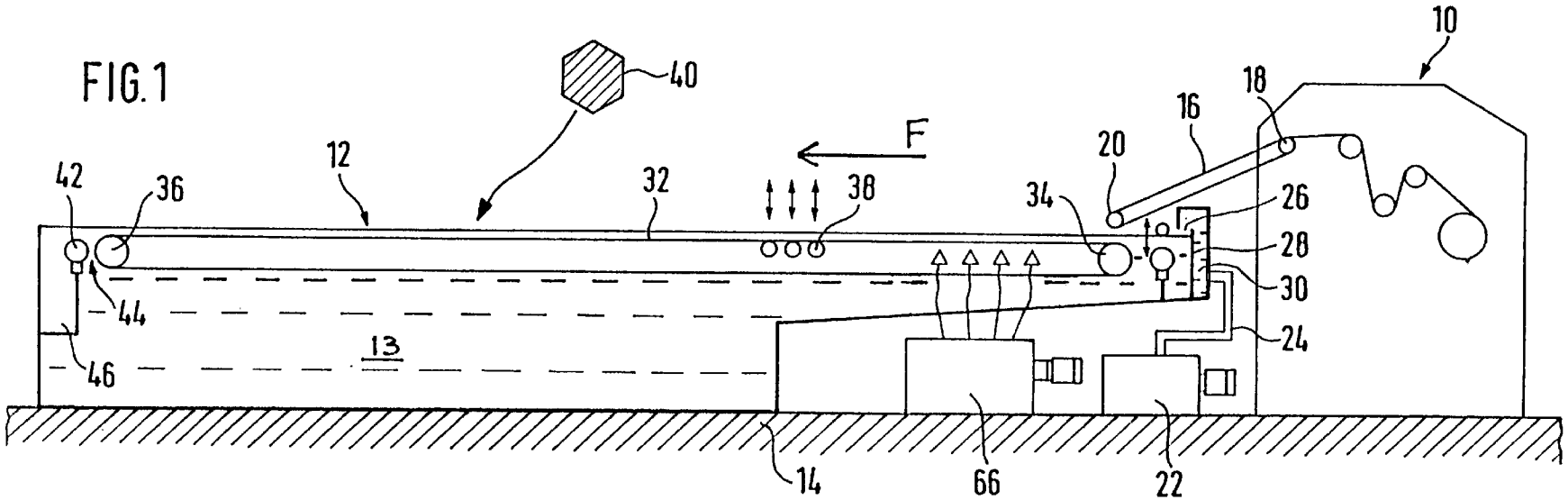
FIG. 1 schematically shows from the side an apparatus for applying a decoration to an article.

Shown on the right in FIG. 1 is a housing 10 in which a printed film is fed over rollers to a tank 12. The chemical and physical structure of the film is not the subject of this invention, nor is the chemical and physical structure of the decoration applied to the film. Such decorations and supporting film are well-known by those skilled in the art.

The housing 10 and the water tank 12 stand on a common foundation 14 which supports the entire installation in a manner affected as little as possible by external mechanical disruptive influences.

Figure 5:
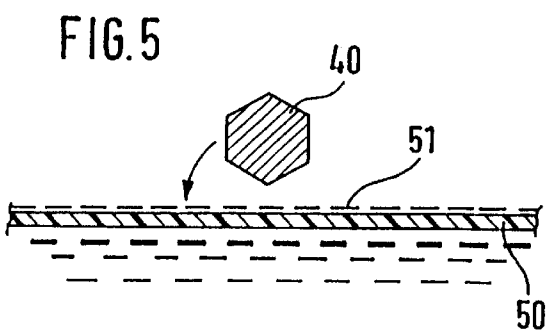
FIG. 5 schematically shows an article to be decorated floating on the water surface with a decoration.

The film 50 (see FIG. 5), with a decoration 51 printed on its upper side, is led from the housing 10 (FIG. 1) to the surface of the water in the tank 12 via a film feed 16 in the form of an obliquely running conveyor belt. The conveyor belt of the film feed 16 runs over rollers 18, 20. As generally shown in FIG. 5, the decoration 51 to be applied to an article 40 rests upon a film 50 which floats upon a surface of water.

The water flows through the tank 12 from right to left in FIG. 1. A pump 22 maintains water circulation between a reservoir 13 and a water inlet 26 of the tank 12. A supply line 24 leads from the pump 22 into a cavity 30. The cavity 30 is filled and water is pumped over a dam wall 28 at a height which lies above the surface of the water in the tank 12 to the water inlet 26. The flow path of the water is illustrated in more detail by arrow 48 in FIG. 3. The feeding of the water into the tank 12 will also be described in more detail below.

Figure 2:
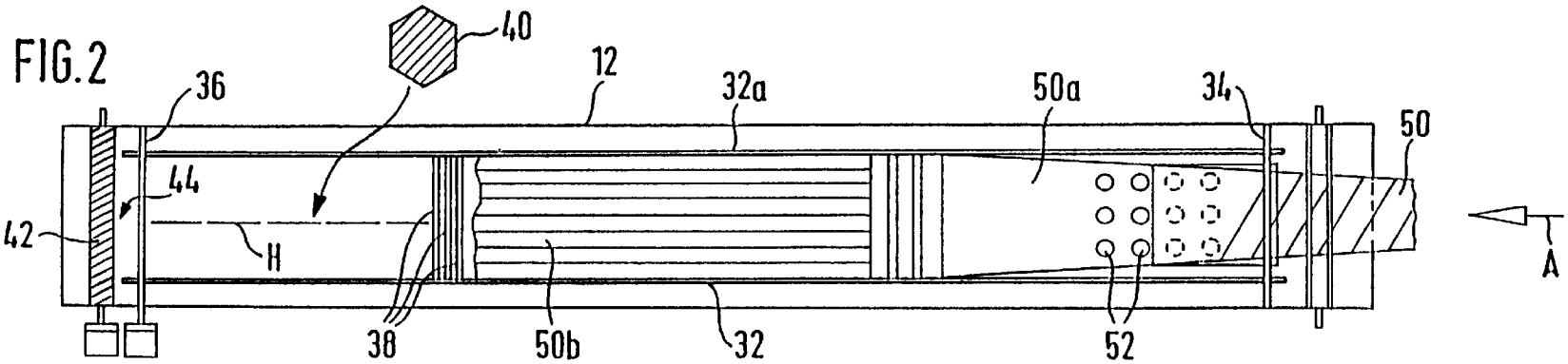
FIG. 2 shows a plan view of an apparatus according to FIG. 1.

As shown in FIGS. 1 and 2, lateral guide tapes 32, 32*a* are used to advance the film 50. The film 50 is provided with the decoration and moved via the film feed 16 in the flow direction F (from right to left in the figures) which is in the longitudinal direction A along the tank 12. The guide tapes 32, 32*a*, which are arranged at the sides as seen in FIG. 2, are supported by and move along rollers 34, 36 which extend over the entire width of the tank 12. Roller 36 has an additional function. In cooperation with another roller 42 arranged downstream of the roller 36 and which also extends over the entire width of the tank 12, these rollers function to separate film and decoration residues from the water.

As is known by those skilled in the art, the article 40 to be printed is immersed into the water in the tank 12 from above. At the same time, the film and decoration are floating on the surface of the water, approximately at the level of the lateral guide tapes 32, 32*a* in FIG. 1.

FIG. 5 shows schematically the immersion of the article 40 in the liquid on which the supporting film 50 and the decoration 51 float. The decoration 51 is laid in three dimensions around the article 40 and adheres to the article. In the process, the film 50 may, in large part, if not completely, dissolve in the water before the immersion operation. The article 40 is then pressed directly from above into the decoration 51 floating on the liquid. Hydrostatic pressure on the floating decoration 51 urges the decoration 51 against the article 40 and, as a result, the transfer operation takes place.

Using this technique, it is possible to apply decorations to complicated three-dimensional articles in a manner true to scale. During this process, residues of the film and of the decoration, which cannot be used further, remain in the flowing water. For example, film may be made of PVA (polyvinyl alcohol), which is soluble in water and may leave residue in the water.

In the arrangement of the rollers 36 and 42 that is shown in FIG. 1, a narrow gap 44 exists between the rollers. Film residues and decoration residues that are conveyed over the roller 36 pass to the roller 42. They are then passed on by the rotation of the roller 42 to a filter 46 which separates the film and decoration residues from the water and discharges clean water back to the pump 22. As a result of the narrow gap 44 between the rollers 36 and 42, relatively clean water returns into the lower regions of the tank 12 where it may be returned to pump 22.

Figure 3:
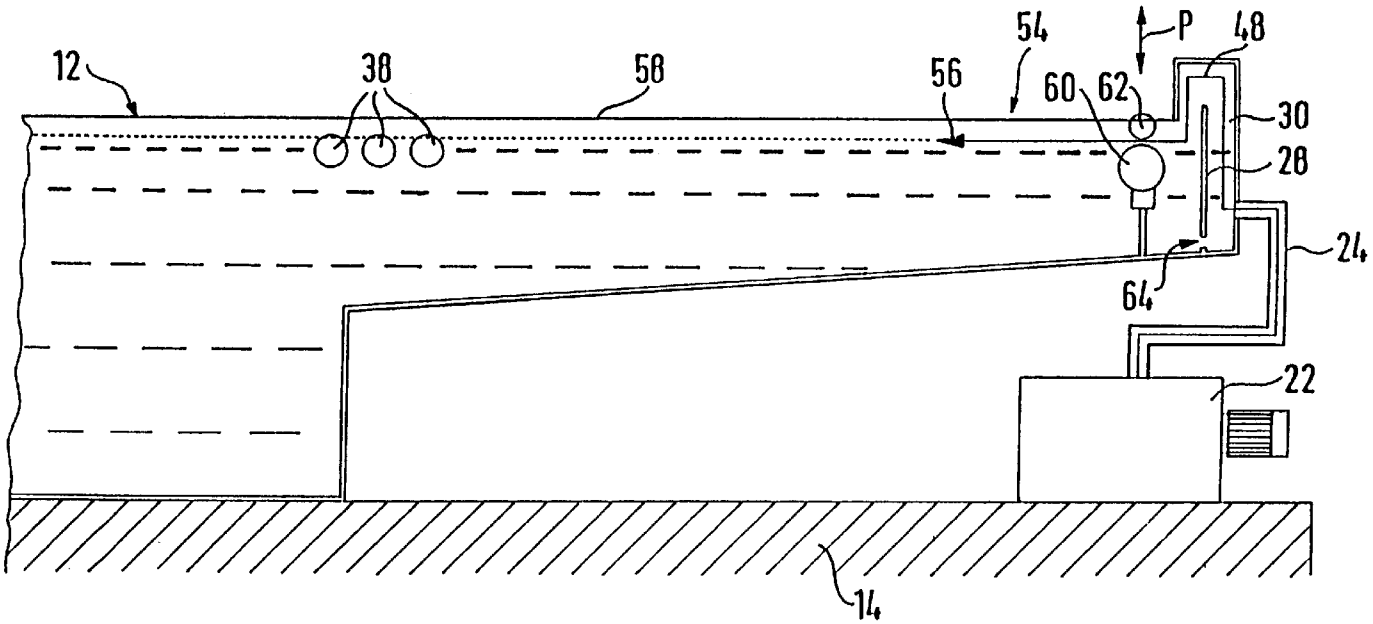
FIG. 3 shows a side view of an upstream section of the apparatus according to FIG. 1 with the water feed.

FIGS. 2 and 3 show schematic drawings of the apparatus from above and from the side. FIG. 3 illustrates details of the introduction of the water into the tank. As already discussed above with reference to FIG. 1, the water rises in the cavity 30 over the dam wall 28 and falls from there into the tank 12. Provided under the dam wall 28 is an opening 64 through which the excess water can enter the tank 12 directly.

The path of the water over the dam wall 28 is illustrated schematically using continuous line 48 in FIG. 3. The water is fed into the tank through a space between two rotating rollers 60, 62. The two rollers 60, 62 are arranged vertically one above the other and are vertically adjustable in the direction of an arrow P. While preferably both rollers 60, 62 have rotary drives, at least one roller, such as the lower roller, has a rotary drive. The rotational speed of the rollers is such that the water is conveyed in a direction corresponding to an arrow 56. The arrow 56 also marks the surface of the water in the tank 12.

In FIG. 3 the lower roller 60 rotates in the counterclockwise direction and the upper roller 62 rotates in the clockwise direction. By means of adjusting the vertical height of the rollers 60, 62, adjusting their spacing from each other and adjusting the rotational speed, the flow of the water into the tank may be optimally controlled. For instance, the spacing of the two rollers may be about 1 cm, depending on the requirements of the article to be printed. The amount of water fed in is controlled by the spacing. The flow speed at the surface 56 in the tank 12 may be influenced by the rotational speed of the rollers and primarily by the rotational speed of the lower roller 60. The rollers 60, 62 are preferably designed using stainless steel to provide a smooth surface.

The level of the water in the tank 12 is continuously measured by means of a sensor (not shown). Any undesired waves that may occur are ascertained. This information is passed to a computer that controls all the adjustable components and this computer evaluates the information appropriately. For instance, if waves occur, the computer can change the rotation, position and vertical spacing of the rollers 60, 62 in order to prevent the occurrence of waves and to keep the water surface calm.

The film 50 that slides down from the film feed 16 and has the printed decoration passes onto the water surface in the tank 12 approximately at a point 54. At that point it floats on the surface and is carried along with the flow.

Figure 4B:
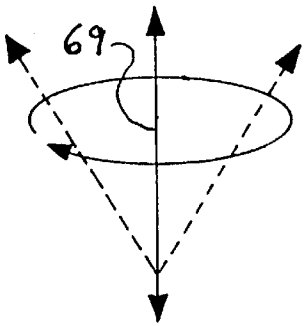
FIGS. 4A and 4B schematically show a nozzle for producing a water flow in an adjustable direction.
Figure 4A:
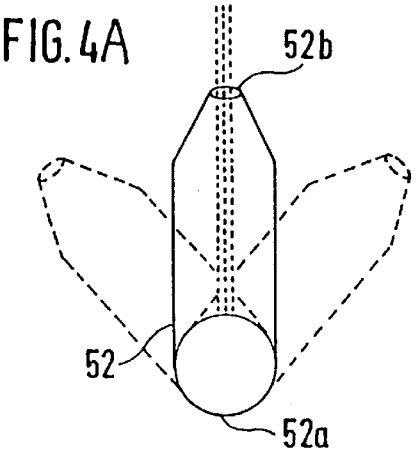

Arranged in the tank underneath the water surface 58 is a plurality of nozzles 52 which can be used to produce flows in various directions in the water. FIG. 4A shows the nozzles schematically in an enlarged illustration and also shows their optional orientation for changing flow directions as a function of the desired shaping of the film in accordance with the article to be printed. To provide adjustability of the flow direction, the nozzle 52 is pivotable about a base 52*a* and has a discharge orifice 52*b*. An axis 69 shown in FIG. 4B defines the flow direction, which is adjustable, of the nozzle 52.

According to the plan view of FIG. 2, in one embodiment illustrated, an array of twelve nozzles in a 3×4 arrangement is positioned such that desired flows can be produced virtually at any desired point on surface 58 of the water. The nozzles 52 discharge a water flow upward or obliquely upward in order to expand or compress the expansible and compressible film, together with the decoration, in the desired manner at the surface of the water. In a region 50*a* (FIG. 2), the film floating on the surface 58 of the water in the tank is thus expanded or compressed in accordance with the requirements of the article to be printed (not shown).

A pump 66 which drives the water through the nozzles 52 is illustrated schematically in FIG. 1, and four arrows which symbolize the individual nozzles are indicated above the pump 66.

In a region 50*b*, the film with the decoration has reached its desired expanded or compressed form to the greatest possible extent and is conveyed downstream over a plurality of rollers 38. The height of these rollers 38 is adjustable such that by way of their upper edge they align approximately with the water surface 58. The rollers 38 are also used for calming the water surface and furthermore for advancing the film. They are preferably designed to have a smooth surface by using, for example, stainless steel. The rollers preferably each have a rotational drive and are adjustable with respect to rotational speed and height. Using the rollers 38, it is possible for the surface of the water to be kept calm in the downstream region and also to stabilize the advance of the film. If required for the article to be printed, it is possible by means of the rollers 38 for the advance speed of the film to be adjusted to be faster or slower than the flow speed of the water. Faster flow is advisable, in particular, if the article to be printed has to be immersed very deeply in the tank or if the article has to be immersed rapidly. Increasing the advance speed of the film in relation to the flow speed of the water prevents the film from tearing.

In the embodiment illustrated, three rollers 38 are used. These are cylindrical and are each adjustable independently of one another for vertical position, rotational speed and horizontal spacing. The rollers 38 can be used to control the feeding of the decorative film 50 into the printing region.

FIGS. 6–10 show details of an apparatus which can be used together with the decoration application apparatus according to FIGS. 1–5. The apparatus shown in FIGS. 6–10 is used to move one or more articles which are to be decorated using the described technique through the tank in the shortest possible time while retaining good quality in applying the decoration. These benefits should be achieved in such a way that the flow of the water is disturbed little by the movement, and the generation of waves on the water surface is minimized to the greatest possible extent.

Figure 6:
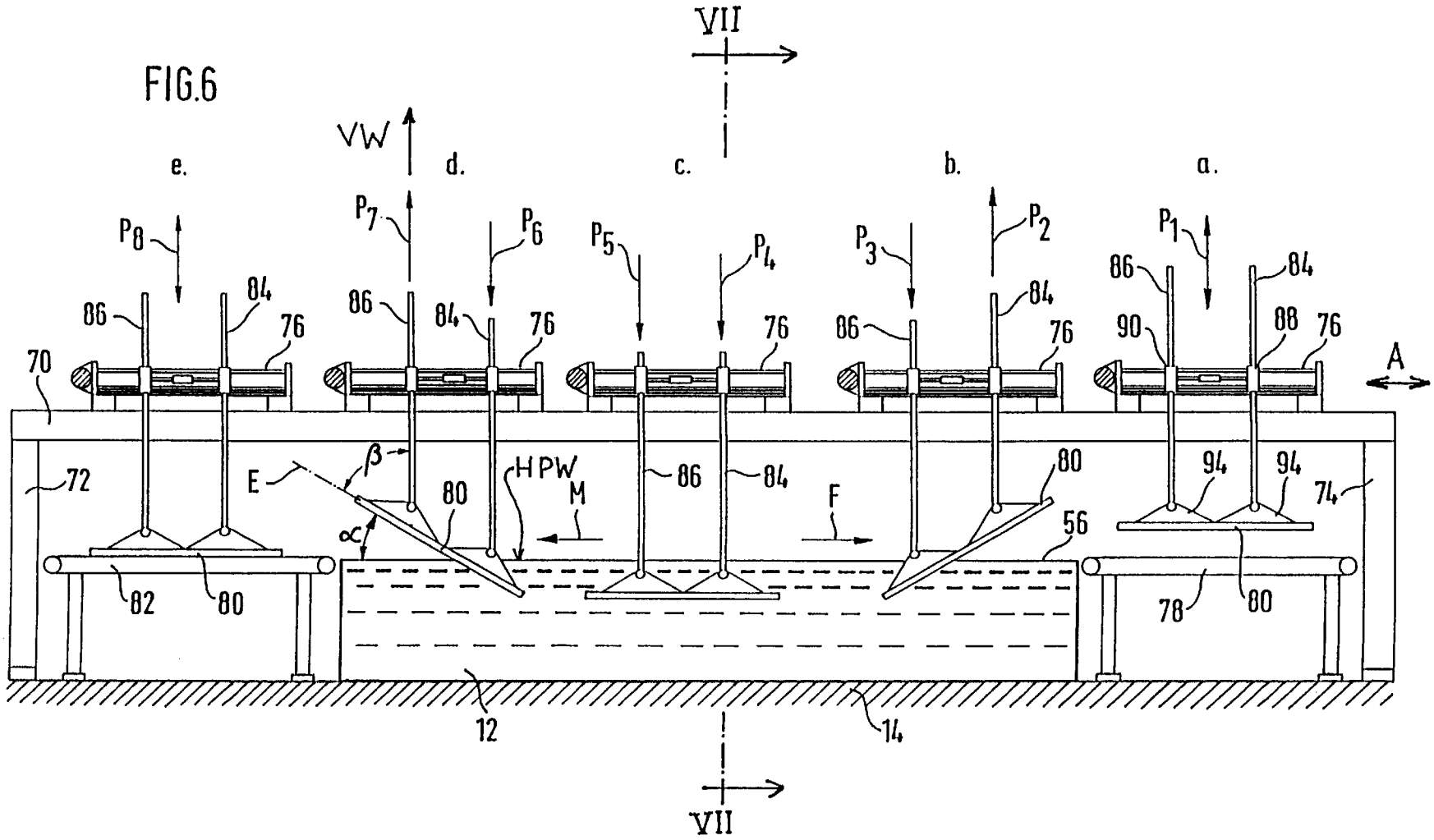
FIG. 6 schematically shows a rail with a carriage arranged thereon, in several operating positions.

FIG. 6 shows a side view of the apparatus with the tank 12 shown in FIG. 1 illustrated schematically. The other features that were previously described to produce the water flow and to apply the decoration to the water surface have been left out. The subassemblies illustrated in FIG. 6 are used for the transport of articles through the tank 12. In FIG. 6, the flow direction of the water is indicated by arrow F. This is opposite to the flow in FIG. 1, where the flow is from right to left. The direction of movement of the article through the tank is indicated by arrow M. This is opposite to the flow in FIG. 1, where the article is moved from left to right.

Figure 7:
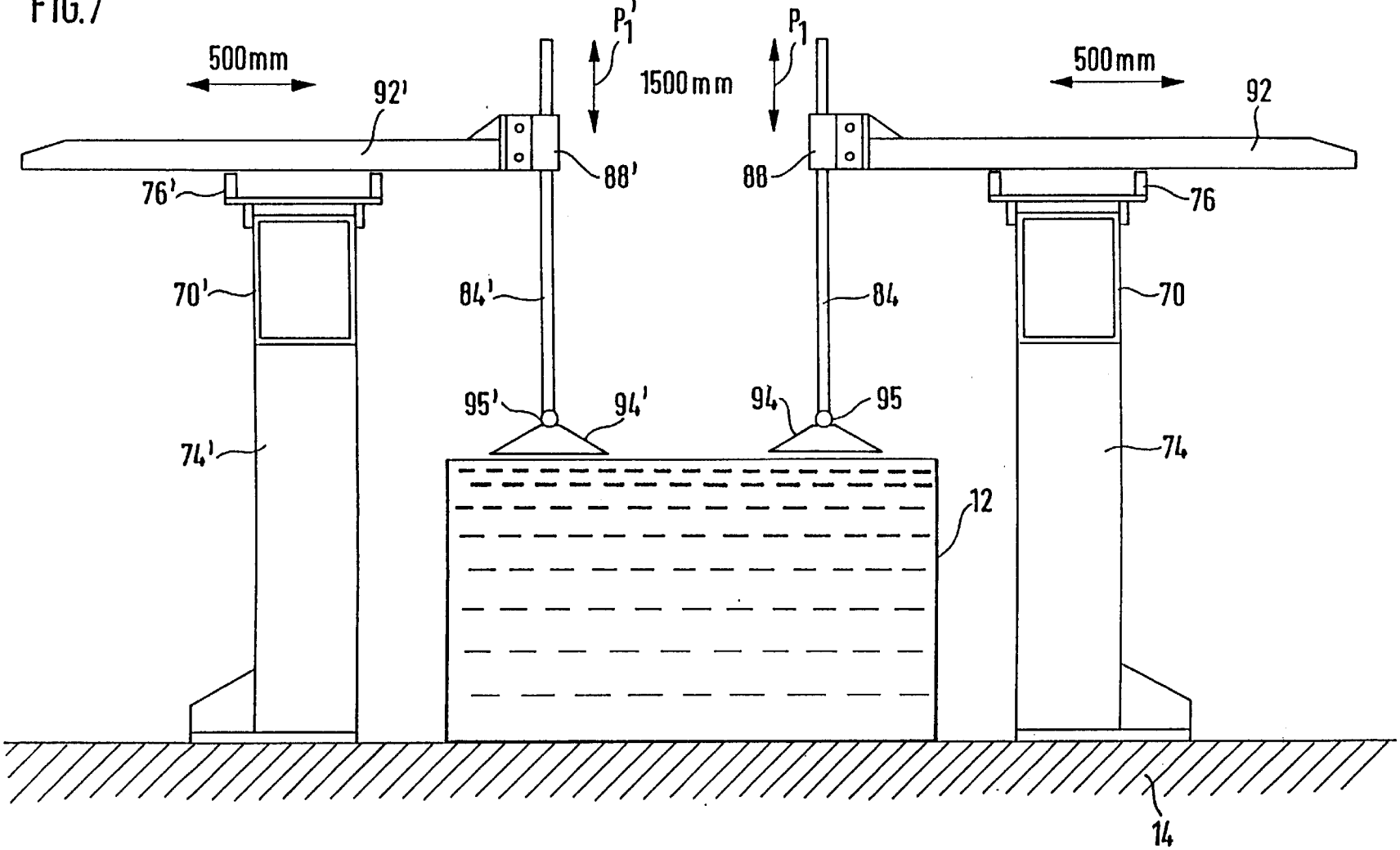
FIG. 7 shows a section of the apparatus according to FIG. 6 along the line VII—VII from FIG. 6.

A rail 70 extends alongside the tank above its upper edge. FIG. 7 shows a section along the line VII—VII of FIG. 6. FIG. 7 shows that rails 70, 70' extend on both sides of the tank 12. Rail 70 is supported by supports 72 and 74 (FIG. 6). Rail 70' is supported by support 74' (FIG. 7) and another support not visible but similar to support 72 in FIG. 1.

At least one carriage 76 is arranged on rail 70, and at least one other carriage 76' is arranged on rail 70'. These arrangements are identical and therefore carriage 76 will be discussed. The carriage 76 slides on the rail 70 in the longitudinal direction A of the tank, which is from left to right and vice versa in FIG. 6 and at right angles to the plane of the drawing in FIG. 7. FIG. 6 shows carriage 76 in five different operating positions (a), (b), (c), (d) and (e).

In FIG. 6 the liquid flows in the direction of the arrow F and a pallet 80 is moved in the direction of arrow M. The pallet 80 is fed on a conveyor belt 78 and is picked up by the carriage 76 in the position (a). The carriage 76 has arms 84, 86 which are adjustable vertically in the direction of arrow $P_1$. For the purpose of vertical height adjustment, the arms 84, 86 slide in guides 88, 90. Details of the motor drive for this height adjustment are not illustrated in FIG. 6 but are known to those skilled in the art.

Arrows $P_1$ through $P_8$ which will be discussed will also represent vertical axes extending through the respective arm 84, 86.

Arranged at the lower ends of the arms 84, 86 are spherical joints 95 (FIG. 7) which permit the pallet 80 and suction nozzles 94 to be pivoted in all directions, as shown by comparison of the positions (a) and (b) of FIG. 6. In order to pick up a pallet 80 that is resting on the conveyor belt 78, as illustrated in position (a), the two suction nozzles 94 are moved downward in accordance with the arrow $P_1$ and a vacuum pump (not shown) is actuated to produce a vacuum with which the suction nozzles 94 pick up the pallet. A plurality of articles which are to be decorated, although not specifically illustrated, is removably fastened to the pallet. The pallet 80 therefore may accommodate a multiplicity of articles to be decorated simultaneously.

The pallet 80 is guided for applying decorations to the articles in a fashion previously described through the tank 12 with the decorative film floating thereon. The movement sequence is shown in FIG. 6. As the position (b) shows, the arms 84, 86 are adjustable in their vertical height independently of each other. Each arm 84, 86 may be displaced along its longitudinal axis in the guides 88, 90. In position (b), the arm 86 is lowered with respect to the arm 84, as indicated by the arrows $P_2$ and $P_3$. At the same time, the horizontal spacing of the arms 84, 86 changes and the guides 88, 90 slide in the horizontal direction on the carriage 76 to accommodate this change.

The carriage 76 slides as a whole on the rail 70. In the position (c), the pallet 80, with the articles to be decorated fastened thereon, is immersed in the liquid in the tank 12 over the decorations to be applied to the articles. In this manner the decorations are applied to the articles.

Position (d) shows the pallet 80 emerging from the tank 12. The arrows $P_6$ and $P_7$ indicate the corresponding vertical movement of the arms 84, 86. As a result of the described vertical adjustment of the arms 84, 86, a plane E of the pallet 80 can be adjusted in relation to a vertical axis VW which extends perpendicular to the surface of the water and in FIG. 6 happens to be coaxial with arrow $P_7$. This adjustment is illustrated in FIG. 6 by an angle $\beta$. The angle between the plane E of the pallet and horizontal plane HPW parallel to the surface of the water is designated by $\alpha$. After each article is decorated, the pallet 80 is deposited on a conveyor belt 82 and the carriage 76 may return to position (a) to pick up a new pallet with articles to be decorated.

As can be seen from FIG. 7, in this embodiment rails 70, 70' are in each case provided on both sides of the tank 12 and in each case a carriage 76, 76' slides on said rails in the longitudinal direction of the tank 12, that is to say, at right angles to the plane of the drawing in FIG. 7. Details of carriage 76' are identical to those of carriage 76 and like parts will be identified for carriage 76' with identical reference numbers but with a prime mark "'" on the numbers. Using the arrangement of two carriages in FIG. 7, one on each side of the tank, it is possible for the throughput and hence the decoration capacity of the installation to be increased significantly since the carriages can be arranged in a manner offset with respect to one another in the longitudinal direction A of the tank. The longitudinal direction A is at right angles to the plane of the drawing in FIG. 7. Each carriage may move a pallet through the tank 12 in sequence. As an example, it is possible for the carriage 76' that is depicted on the left in FIG. 7 to be in the operating position (b) in FIG. 6 and the carriage 76 that is depicted on the right in FIG. 7 to be in the position (c) in FIG. 6.

Figure 8:
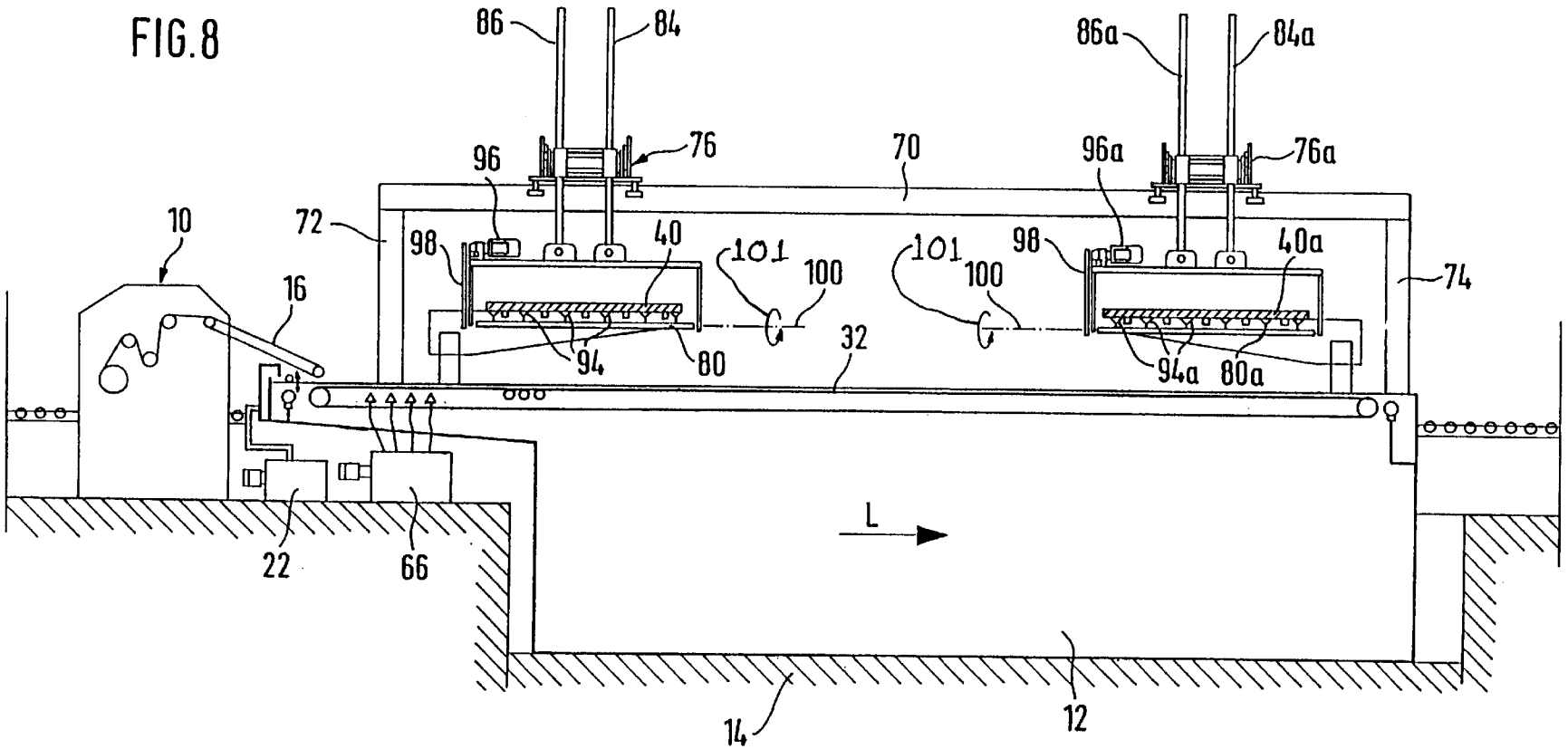
FIG. 8 shows a side view of the apparatus in which components illustrated in FIG. 6 and FIG. 1 are illustrated together.
Figure 9:
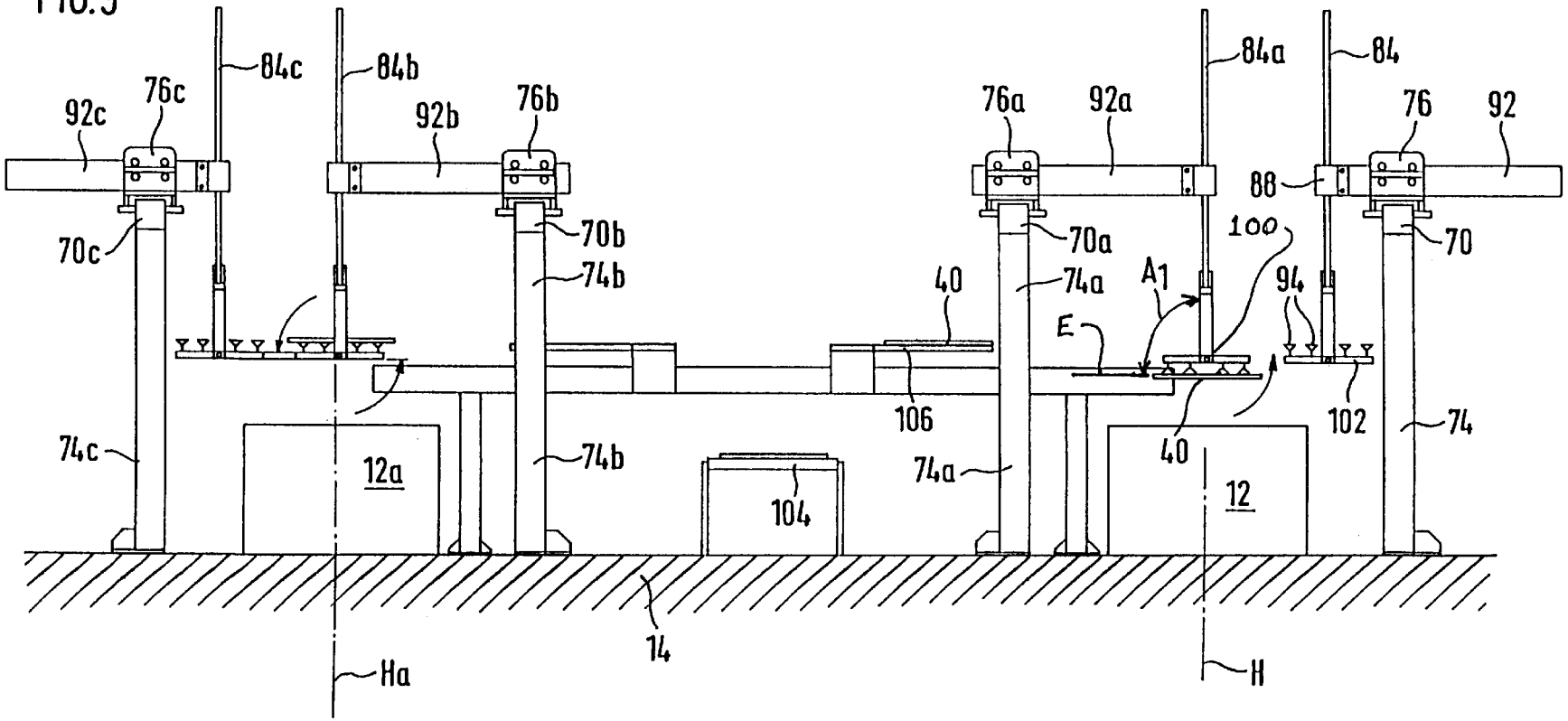
FIG. 9 shows an end view of a further embodiment of an apparatus for applying a decoration, having two tanks and four rails for the transport of, in each case, one carriage with which a pallet can be moved through the tank.

FIG. 8 shows the overall installation, including the tank 12 previously explained with reference to FIGS. 1 to 5 and the devices for feeding and controlling the decorative film on the liquid surface of the tank 12. As a supplement to FIGS. 6 and 7, FIG. 8 also shows a further embodiment in which the pallet 80 is pivotally mounted and rotatable as shown by arrow 101 about an axis 100 by means of a motor 96 and a belt 98. FIG. 9 illustrates a line H through the center of tank 12 and a line $H_a$ through the center of a tank 12*a*. These lines are intended to represent planes defined by the intersection of a line perpendicular to the surface 58 of the water and a line parallel to the flow F (FIG. 6) of the water. Each of these planes will be referred to as a main plane of movement.

The belt 98 transmits the rotation of the motor 96 to the pallet 80, which permits the rotation that is illustrated by an arrow 101 at the axis of rotation 100. This rotation makes it possible for the angle $A_1$ (FIG. 9) between the plane E of the pallet and the main plane H of movement to be adjustable. In FIG. 8, one large article 40 is fastened to the pallet 80 by means of a multiplicity of suction nozzles 94. FIG. 8 shows on the right a further carriage 76*a* having corresponding arms 84*a*, 86*a* and an article 40*a* which is detachably fastened to a pallet 80*a* by means of suction nozzles 94*a*.

FIG. 9 shows an exemplary embodiment having two tanks 12, 12*a* and a conveyor belt 104 arranged between them. FIG. 9 is a section at right angles to the longitudinal axis A which is the direction of water flow in the tanks 12, 12*a*. The main planes of movement H and $H_a$ are therefore at right angles to the plane of the drawing of FIG. 9. In each case transverse arms 102 having a plurality of suction nozzles 94 are fitted to each of the arms 84, 84*a*, 84*b*, 84*c*. Using the suction nozzles 94, it is possible for pallets or even individual articles 40 to be attached by suction and guided as previously described through the tanks 12, 12*b*. The carriages 76, 76*a*, 76*b*, 76*c* slide on rails 70, 70*a*, 70*b*, 70*c*. In addition, provision is made for horizontal carriers 92, 92*a*, 92*b*, 92*c* which can be translated in relation to the carriages 76. The carriers 92, 92*a*, 92*b*, 92*c* may also be rotated relative to the carriages 76, 76*a*, 76*b*, 76*c* using devices for rotation known by those skilled in the art. Using arms of this type, it is possible for each transverse arm 102 to be moved between the conveyor belt 104 and the associated tank.

FIG. 9 also shows the pivotability of the transverse arms 102 in accordance with the arrow $A_1$, which also illustrates the angle between the horizontal plane E and the main plane H of a pallet plane E that is guided through a tank 12, 12*a*. The pallet may be pivoted about axis 100 through the entire angle range illustrated by $A_1$. This rotation about axis 100 may be used to supplement the ability to rotate the pallet or individual article about an axis horizontal to but perpendicular to the flow of water as illustrated in FIG. 6.

FIG. 9 also shows a table 106 on which the articles to be decorated may be deposited.

Figure 10:
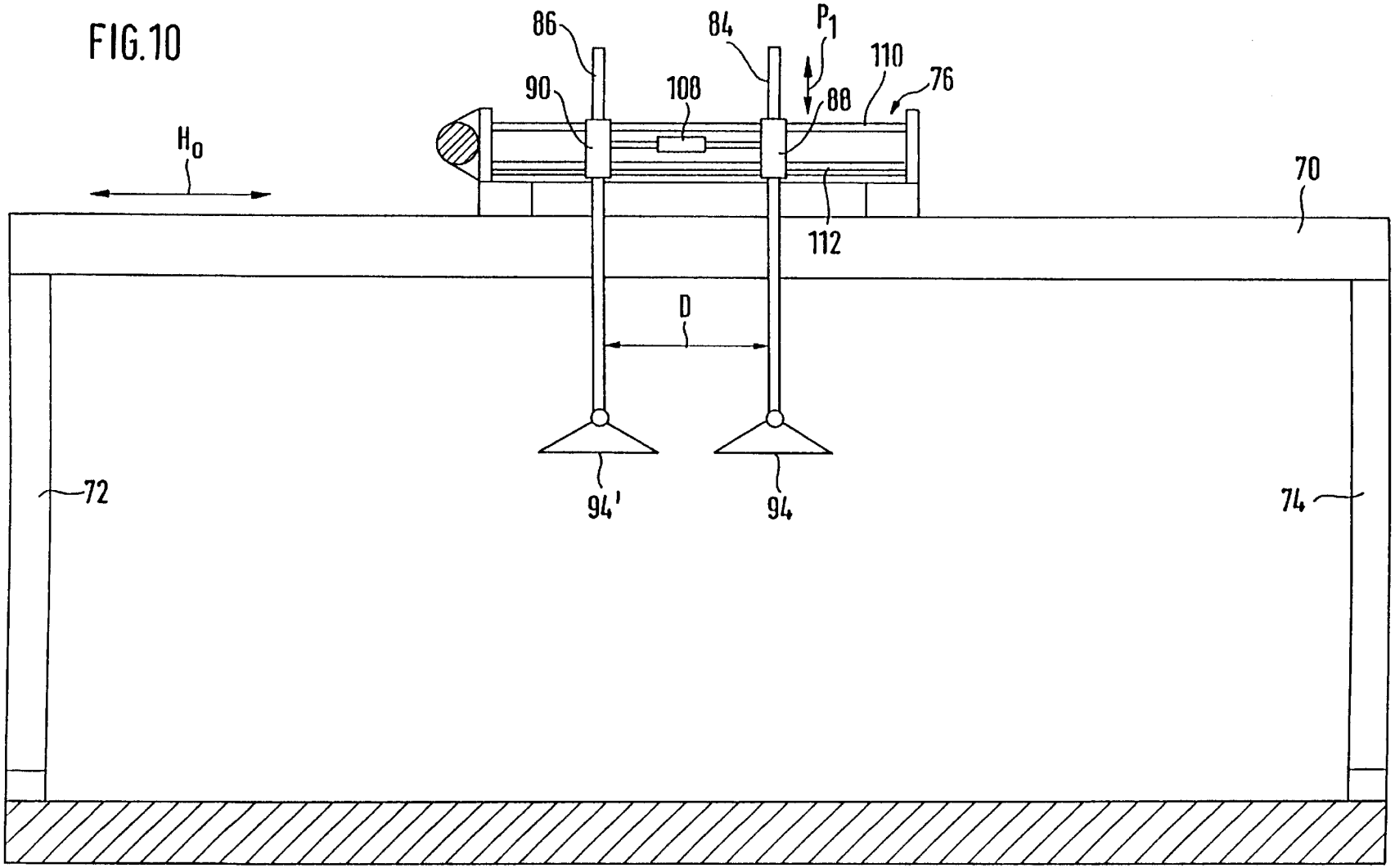
FIG. 10 shows an enlarged illustration of a carriage which is on a rail and has height adjustable arms.

FIG. 10 shows, in an enlarged illustration, details of the carriage 76 which slides on the rail 70. The guides 88, 90 are horizontally displaceable on rods 110, 112 in the direction indicated by an arrow $H_o$. In addition to the vertical height adjustment of the arms 84, 86 corresponding to the arrow $P_1$, it is also possible for horizontal spacing D of the two arms 84, 86 to be adjusted. A mechanism 108 may be used for such adjustment and may be made of drive motors or any other suitable mechanism known to one skilled in the art.

What is claimed is:

1. An apparatus for applying a decoration onto an article in which the article is immersed into a flowing liquid upon which the decoration is floating, wherein the flowing liquid resides in a tank and defines a horizontal plane, the apparatus comprising:

a) a pallet upon which the article is fastened, wherein the pallet generally defines a plane, b) a mechanism for rotating the pallet such that the pallet plane forms an angle relative to the horizontal plane, and c) wherein the mechanism for rotating the pallet comprises at least two arms, each of the arms has a longitudinal axis and each arm is independently height-adjustable vertically in the direction of its longitudinal axis.

2. The apparatus according to claim 1 wherein the mechanism for rotating the pallet is comprised of a motor drive associated with each arm.

3. The apparatus according to claim 1 wherein the pallet is removably attached to the arms.

4. The apparatus according to claim 2 wherein the pallet is removably attached to the arms by a suction device.

5. The apparatus according to claim 1 wherein the pallet is fastened to the arms in an articulated manner such that the plane of the pallet forms an adjustable angle relative to the vertical axes of the arms.

6. The apparatus according to claim 1 wherein the arms are supported by a carriage which can be displaced on a rail oriented in the longitudinal direction of the tank.

7. The apparatus according to claim 6 wherein the carriage is driven along the rail by a motor.

8. The apparatus according to claim 6 wherein a separate carriage is mounted upon each of two rails positioned on opposite sides of the tank.

9. The apparatus according to claim 1 wherein the pallet is mounted upon the carriage such that the angle between the plane of the pallet and the main plane of movement of the article is adjustable.

10. The apparatus according to claim 9 wherein the angle is adjusted using a motor which is supported on the carriage.

* * * * *